US009999102B2

(12) United States Patent
Iguro et al.

(10) Patent No.: US 9,999,102 B2
(45) Date of Patent: Jun. 12, 2018

(54) INDUCTION HEATING APPARATUS

(71) Applicant: DENSO CORPORATION, Kariya, Aichi-pref. (JP)

(72) Inventors: Shuntaro Iguro, Chiryu (JP); Yoshihide Itou, Kasugai (JP); Kazuhiro Umetani, Kariya (JP); Satoshi Takeuchi, Nagoya (JP)

(73) Assignee: DENSO CORPORATION, Kariya (JP)

( * ) Notice: Subject to any disclaimer, the term of this patent is extended or adjusted under 35 U.S.C. 154(b) by 465 days.

(21) Appl. No.: 14/433,811

(22) PCT Filed: Oct. 4, 2013

(86) PCT No.: PCT/JP2013/077130

§ 371 (c)(1),
(2) Date: Apr. 6, 2015

(87) PCT Pub. No.: WO2014/054793

PCT Pub. Date: Apr. 10, 2014

(65) Prior Publication Data

US 2015/0282256 A1 Oct. 1, 2015

(30) Foreign Application Priority Data

Oct. 4, 2012 (JP) ..... 2012-222164

(51) Int. Cl.
*H05B 6/04* (2006.01)
*H05B 6/10* (2006.01)
(Continued)

(52) U.S. Cl.
CPC ..... *H05B 6/365* (2013.01); *H05B 6/06* (2013.01); *H05B 6/101* (2013.01); *H05B 6/104* (2013.01); *H05B 6/40* (2013.01); *H05B 6/44* (2013.01)

(58) Field of Classification Search
CPC ..... H05B 6/365; H05B 6/06; H05B 6/101; H05B 6/40; H05B 6/104; H05B 6/44
(Continued)

(56) References Cited

U.S. PATENT DOCUMENTS 2,182,341 A * 12/1939 Hulster ..... H01J 9/38 219/632
4,321,444 A * 3/1982 Davies ..... H05B 6/02 219/646

(Continued)

FOREIGN PATENT DOCUMENTS

CN 101707908 A 5/2010
CN 102652459 A 8/2012

(Continued)

OTHER PUBLICATIONS

Dec. 3, 2013 Search Report issued in International Patent Application No. PCT/JP2013/077130.

(Continued)

*Primary Examiner* — Quang Van
(74) *Attorney, Agent, or Firm* — Oliff PLC

(57) ABSTRACT

An induction heating apparatus includes: a core that has a pair of magnetic poles and transfers magnetic flux; a coil generating magnetic flux; conductors adjacently provided on both left and right sides of the magnetic poles; and lateral magnetic members formed of a magnetic material and arranged on an outer side of end portions of the object so as to extend along the end portions. The conductors shut off the magnetic flux that flows from a center portion of the heating object, taking a detour to the end portions, permit the magnetic flux to concentrate on the center portion, and accelerate temperature rise. The lateral magnetic members introduce the magnetic flux that propagates from one surface to the other surface, detouring around the end portions to (Continued)

thereby mitigate the magnetic flux density in the end portions and suppress overheating.

21 Claims, 12 Drawing Sheets

(51) Int. Cl.
*H05B 6/36* (2006.01)
*H05B 6/44* (2006.01)
*H05B 6/06* (2006.01)
*H05B 6/40* (2006.01)

(58) Field of Classification Search
USPC ..... 219/645, 618, 619, 622, 624, 634, 635, 219/637, 646, 647, 660, 663, 664, 671, 219/672; 118/639, 500, 715, 725
See application file for complete search history.

(56) References Cited

U.S. PATENT DOCUMENTS

2009/0145894 A1 6/2009 Goldstein
2010/0072192 A1* 3/2010 Hirota ..... H05B 6/365 219/647
2012/0305547 A1 12/2012 Fukutani et al.
2012/0305548 A1 12/2012 Umetsu et al.

FOREIGN PATENT DOCUMENTS

JP S-56-123496 U1 9/1981
JP H02117087 A 5/1990
JP 2001006861 A 1/2001
JP 2001006862 A 1/2001
JP 2004296368 A 10/2004
JP 2006294396 A 10/2006
JP 2011-216502 A 10/2011

OTHER PUBLICATIONS

Apr. 7, 2015 International Preliminary Report on Patentability issued in International Patent Application No. PCT/JP2013/077130.
Oct. 21, 2015 Office Action issued in Chinese Patent Application No. 201380051778.9.
Dec. 3, 2013 International Search Report issued in International Application No. PCT/JP2013/077130.

* cited by examiner (A)

(B)

[COMPARATIVE EXAMPLE]

[COMPARATIVE EXAMPLE]

INDUCTION HEATING APPARATUS

CROSS-REFERENCE TO RELATED APPLICATIONS

This application is based on and claims the benefit of priority from earlier Japanese Patent Application No. 2012-222164 filed on Oct. 4, 2012 the descriptions of which are incorporated herein by reference.

TECHNICAL FIELD

The present invention relates to an induction heating apparatus that passes alternating current magnetic flux through a heating object to generate induction current by which the heating object is heated, and in particular, to an induction heating apparatus based on a method for introducing magnetic flux in a direction perpendicular to the heating object.

BACKGROUND ART

In factories, a process of heating a metal plate or the like is one important working process. There are various methods of such heating, one of which is an induction heating method. Basically, in the induction heating method, alternating current is supplied to a coil to generate magnetic flux which is introduced to a heating object, such as a metal plate, to generate induction current in the heating object to thereby heat the heating object.

In such an induction heating apparatus, magnetic flux hardly passes through a center portion in a width direction of a heating object (i.e., an object being heated), while easily passing through edge portions of the object. Therefore, magnetic flux that flows from the center portion, circulating around the edge portions, is increased in a magnetic flux distribution and thus the magnetic flux is concentrated on the edge portions to raise magnetic flux density there. As a result, the edge portions tend to be excessively heated, which leads to difficulty in ensuring uniformity in temperature distribution between the edge portions and the center portion (hereinafter is referred to as "heat uniformity").

When a heating object is a thin plate, in particular, a transverse method is generally used, in which magnetic flux is introduced to the heating object in a direction perpendicular to the object. In this case, the edge portions are overheated and thus the heat uniformity is unlikely to be ensured. In this regard, in the induction heating apparatus based on a transverse method disclosed in Patent Literature 1, magnetic members are arranged near edge portions of a heating object so that magnetic flux is collectively passed through the magnetic members to suppress overheating of the edge portions.

CITATION LIST

Patent Literature

[Patent Literature] JP-A-2006-294396

The apparatus disclosed in Patent Literature 1 suppresses overheating of the edge portions of a heating object, but no account is taken, at all, of the fact that magnetic flux is unlikely to pass through a center portion of the heating object. Accordingly, the temperature rise at the center portion is not accelerated, leaving a problem that heating efficiency is not improved.

SUMMARY

Therefore it is desired to provide an induction heating apparatus which is able to suppress overheating in edge portions, while accelerating temperature rise in a center portion, and improve heat uniformity and heating efficiency of heating.

In an exemplary embodiment, there is provided an induction heating apparatus that permits magnetic flux generated by passing current to a coil to flow toward a plate-like heating object having electrical conductivity, and generates induction current to thereby heat the heating object. Thus, the induction heating apparatus is characterized in that the apparatus includes a core, a coil, a conductor (first magnetic flux control element) and a lateral magnetic member (second magnetic flux control element).

The core is formed of a magnetic material capable of transferring magnetic flux, and provided with one or more pairs of magnetic poles arranged such that the magnetic poles in a pair sandwich the heating object therebetween, being imparted with mutually opposite magnetic polarities. The magnetic poles refer to a partial portion that generates magnetic flux.

The coil is wound about the core and generates magnetic flux when alternating current is passed through the coil.

The conductor is provided on at least one of principal plate surfaces (e.g., both side surfaces in a plate thickness direction) of the heating object so as to extend along a principal plate surface of the heating object, while being adjacent to the magnetic poles. The conductor hardly passes alternating current magnetic field therethrough and thus shuts off magnetic flux that flows along the principal plate surface of the heating object toward a direction of departing from the magnetic poles. The term "shuts off magnetic flux" does not necessarily refer to 100% shutoff, but refers to "shutoff of a main flow of the magnetic flux". The conductor is formed of an electrically conductive material, such as copper. In other words, it is preferable that the conductor is formed of a non-magnetic metallic material having magnetic permeability equal to that of the air.

The lateral magnetic member is formed of a magnetic material and is provided to at least one of width-direction end portions of the heating object so as to extend along the edge portion, being distanced from a width-direction center portion of the heating object, and to step over the heating object in the thickness direction. A magnetic material having sufficiently large magnetic permeability compared to the air is used for the lateral magnetic member, the magnetic material specifically corresponding to silicon steel or the like.

For example, when magnetic flux is introduced (radiated) perpendicular to a heating object made of aluminum, the magnetic flux hardly passes through the center portion of the heating object and tends to propagate, taking a detour toward the edge portions.

In this regard, the conductor provided along a principal plate surface of the heating object, while being adjacent to the magnetic poles, shuts off the magnetic flux that flows from the center portion and takes a detour toward the edge portions, permitting the magnetic flux to concentrate on the center portion. Thus, magnetic flux passing through the center portion is increased, temperature rise in the center portion is accelerated, and heating efficiency is improved.

The magnetic flux that has passed through a clearance (i.e., gap or space) between the heating object and the conductor tends to concentrate on the edge portions. In this regard, a lateral magnetic member made of a magnetic material is provided near an edge portion, and the magnetic flux is introduced to the lateral magnetic member to thereby mitigate the magnetic flux density in the edge portion. Thus, overheating of the edge portion is suppressed and heat uniformity is improved.

In this way, when magnetic flux distribution is concerned, the induction heating apparatus mitigates magnetic flux density in an edge portion of the heating object, while permitting magnetic flux to concentrate on the center portion, thereby forming a "target magnetic flux distribution". Thus, heat uniformity and heating efficiency can both be improved.

DESCRIPTION OF EMBODIMENTS

With reference to the drawings, hereinafter are described several embodiments of the present invention.

First Embodiment

Figure 1:
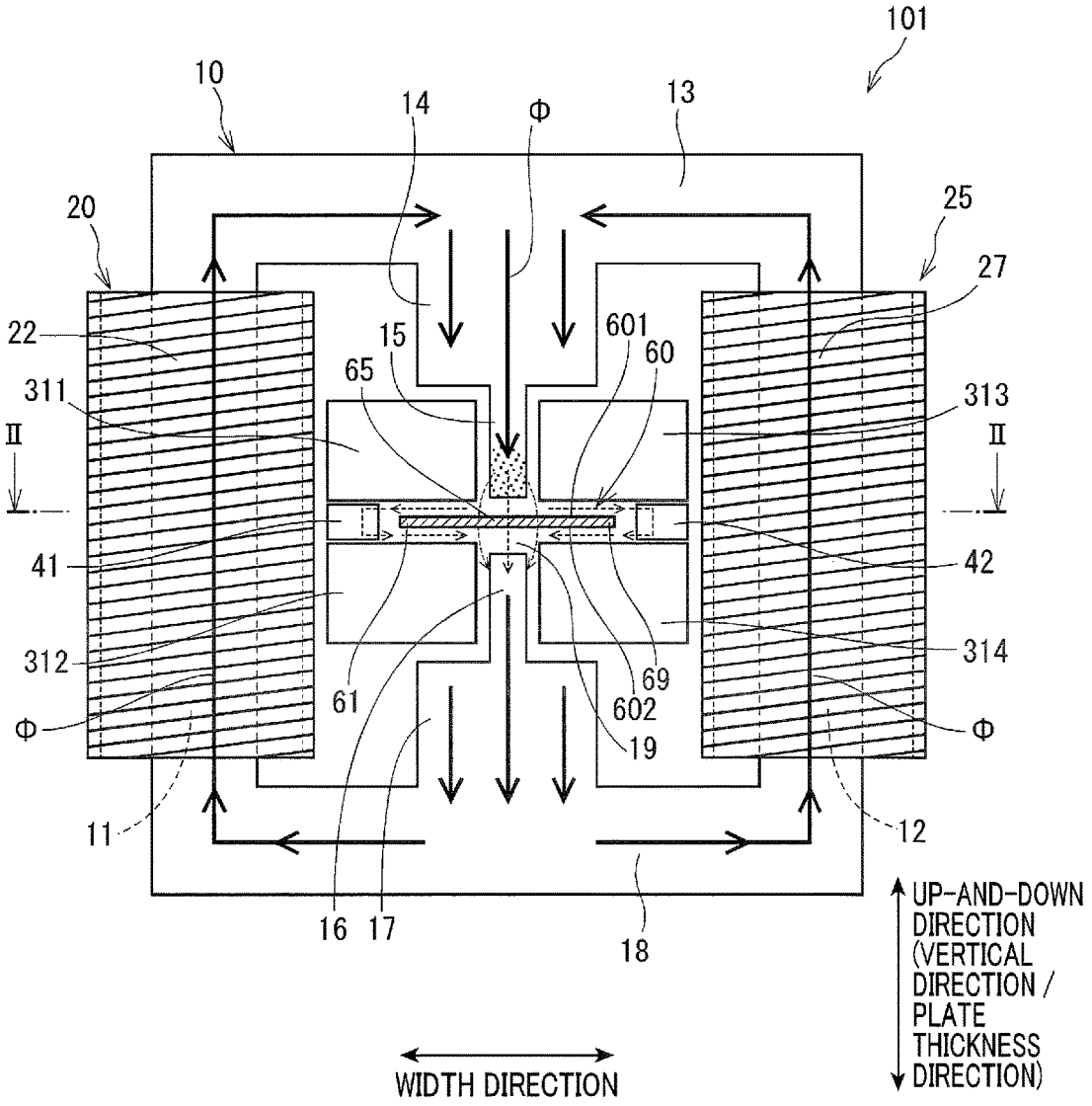
FIG. 1 is a schematic diagram illustrating an induction heating apparatus according to a first embodiment of the present invention.
Figure 2:
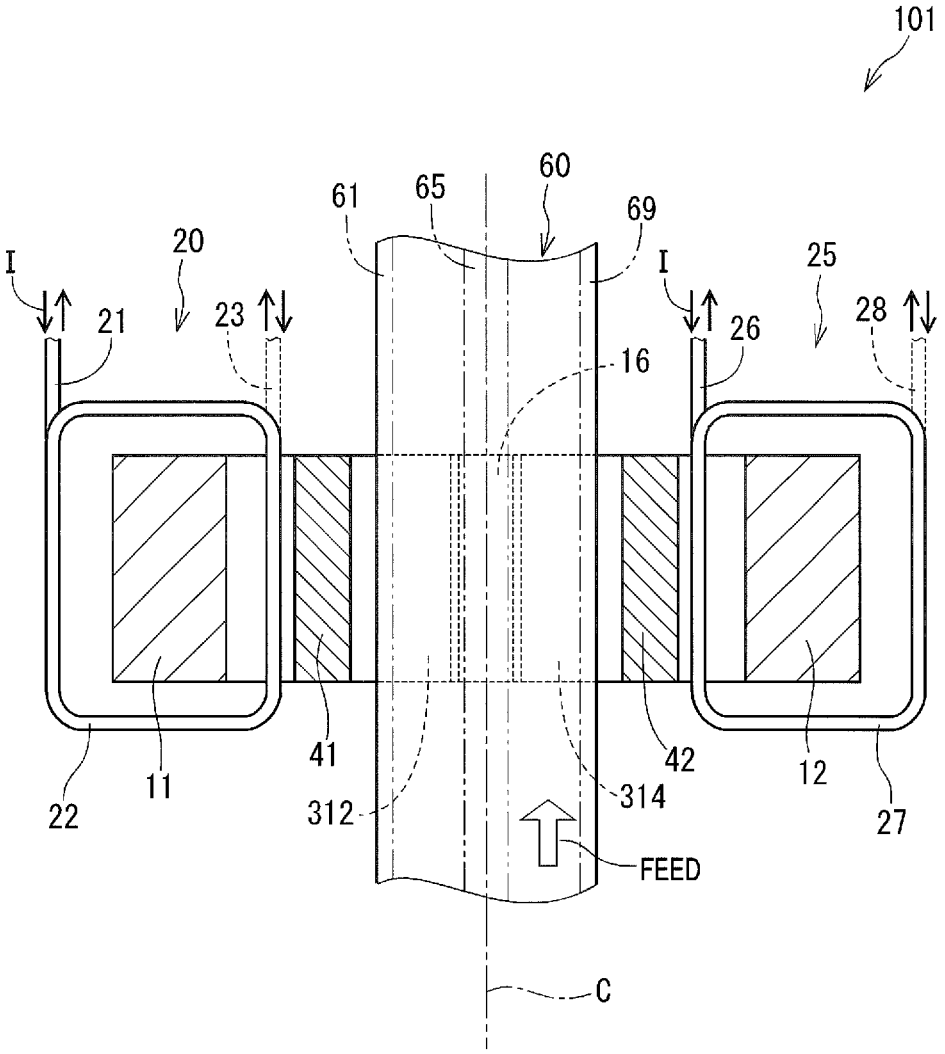
FIG. 2 is a cross-sectional diagram taken along a line II-II of FIG. 1.
Figure 3:
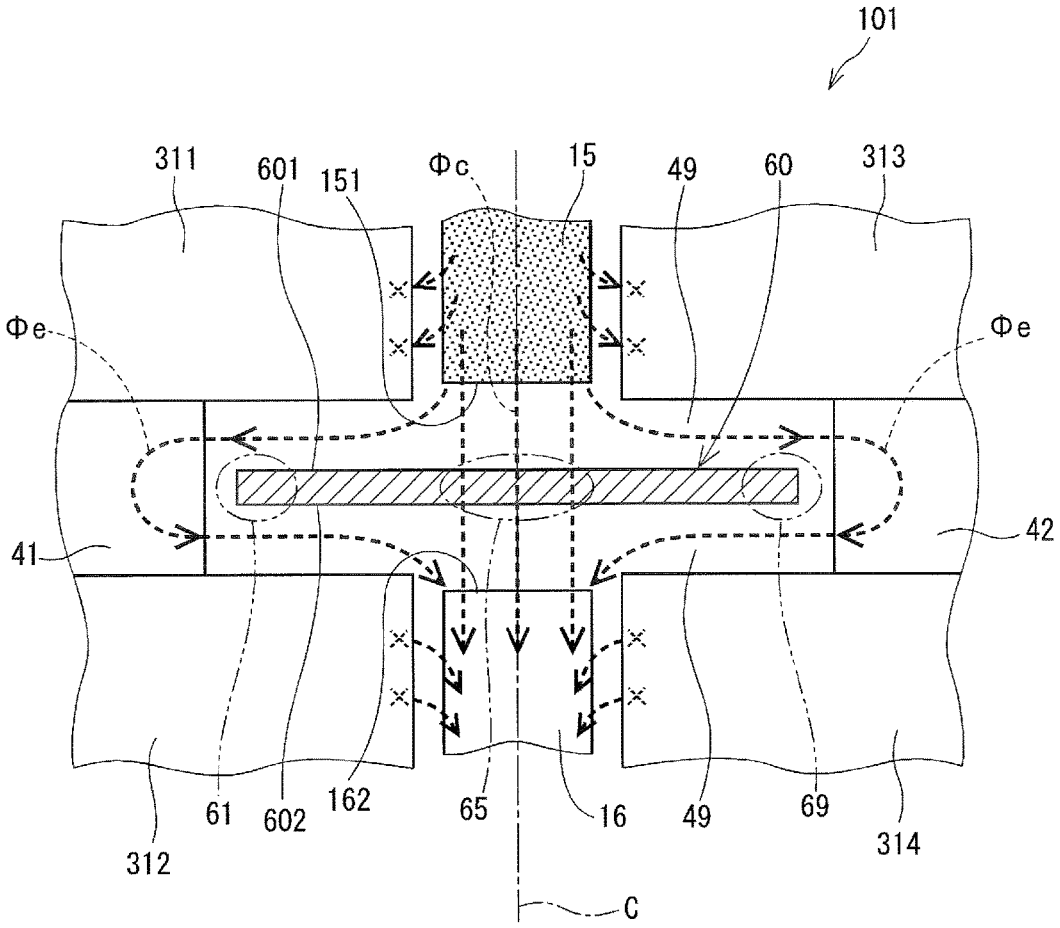
FIG. 3 is an enlarged diagram of a principal portion of FIG. 1.

Referring to FIGS. 1 to 3, an induction heating apparatus of a first embodiment of the present invention is described.

As shown in FIGS. 1 to 3, an induction heating apparatus 101 is a device that heats an electrically conductive plate-like heating object 60 (i.e., an object being heated). In the present embodiment, the induction heating apparatus is set up, with the vertical direction in FIG. 1 as being a vertical direction (plate thickness direction).

The heating object 60 is set so that its principal plate surfaces 601 and 602 reside in a horizontal direction. The "principal plate surfaces" herein refers to surfaces which are subjected to heating. When the heating object 60 is a plate of a substantially rectangular parallelopiped shape, the principal plate surfaces refer to the front and back surfaces having the largest area, i.e. the front and back surfaces (both side surfaces or both surfaces) in a plate thickness direction (in the following description, both side surfaces or both surfaces are referred to as principal plate surfaces). The principal plate surfaces are not necessarily flat but may be curved or may have steps. Further, the right-and-left direction of the heating object 60 in FIG. 1 is referred to as "width direction of the heating object 60".

For example, the electrically conductive and plate-like heating object 60 corresponds to an aluminum plate. In an example shown in FIG. 2, in particular, the heating object 60 is in a long belt-like shape. With a feeding movement indicated by block arrows, the heating object 60 passes through the induction heating apparatus 101 while being heated. As a specific example, the induction heating apparatus 101 of the present embodiment is used, for example, to preheat a thin aluminum plate for use as a heat exchanger tube member.

The induction heating apparatus 101 includes, chiefly, a core 10, coils 20 and 25, conductors 311, 312, 313 and 314 that function as the first magnetic flux control element, and lateral magnetic members 41 and 42 that function as the second magnetic flux control element.

The core 10 is made of a magnetic material, such as grain-oriented silicon steel, and formed into a shape of a square frame. Specifically, the left and right opposite sides configure flux generation portions 11 and 12, while up and down opposite sides configure outer transfer portions 13 and 18. A center portion between the outer transfer portions 13 and 18 is formed with inner transfer portions 14 and 17 extending inward in the frame. Further, a lower end of the upper inner transfer portion 14 and an upper end of the lower inner transfer portion 17 are formed with magnetic poles 15 and 16, respectively. The magnetic poles 15 and 16 each have a width smaller than that of the inner transfer portions 14 and 17, and are projected toward the center of the frame for the concentration of magnetic flux.

The magnetic poles 15 and 16 in a pair are opposed to each other, sandwiching a gap 19 therebetween. The magnetic poles 15 and 16 in a pair are arranged such that, when the heating object 60 is set, their respective ends 151 and 162 are located, being paired in a direction of sandwiching the principal plate surfaces 601 and 602 of the heating object 60. It is preferable that the magnetic poles 15 and 16 in a pair sandwich a center portion 65 of the principal plate surfaces 601 and 602. Further, the heating object 60 is located at substantially a center between the pair of magnetic poles 15 and 16 in the vertical direction.

The coils 20 and 25 have wound portions 22 and 27, respectively, which are wound about the respective flux generation portions 11 and 12 of the core 10. Winding start portions 21 and 26, and winding end portions 23 and 23 are connected to a power output device, not shown.

Upon supply of alternating current I to the coils 20 and 25, magnetic flux Φ is generated in the flux generation portions 11 and 12 of the core 10. The magnetic flux Φ, which has a basic wave component, such as a sine wave, periodically changes its intensity and direction according to the frequency of the alternating current I.

However, for the sake of convenience in the following description, the direction and the like are defined, centering on the magnetic flux Φ at a time point when the waveform of the magnetic flux Φ shows maximum positive amplitude. Thus, as shown in FIG. 1, a period when the magnetic flux Φ is generated upward from below in the magnetic generation portions 11 and 12 of the core 10 is defined to be a period where the flux waveform is positive. In this case, the magnetic flux Φ is transferred by way of the flux generation portions 11 and 12→outer transfer portion 13→inner transfer portion 14→magnetic pole 15→(gap 19)→magnetic pole 16→inner transfer portion 17→outer transfer portion 18→flux generation portions 11 and 12.

The magnetic poles 15 and 16 in a pair constantly exhibit mutually opposite polarities when the instance of zero-crossing of the magnetic flux waveform is ignored. Where the magnetic flux Φ is positive as defined above, and the magnetic pole 15 has a polarity N and the magnetic pole 16 has a polarity S, the magnetic poles 15 and 16 are referred to as a "pseudo N pole 15" and a "pseudo S pole 16", respectively.

In the figures referred to hereinbelow, the pseudo N pole is indicated by fine-dot background, while the pseudo S pole is indicated by white background. Specifically, this means that the magnetic pole indicated by the fine-dot background and the magnetic pole indicated by the white background have opposite polarities. Further, arrows of the magnetic flux Φ are indicated in a direction from the pseudo N pole toward the pseudo S pole.

The conductors 311 to 314 are formed of copper that is an electrically conductive and non-magnetic metallic material having properties of "hardly passing alternating current magnetic field". The "non-magnetic metallic material" herein refers to a metallic material having magnetic permeability equal to the air, i.e. equal to vacuum, and thus is a metallic material having "relative magnetic permeability of about 1". Further, "copper" is not limited to pure copper but includes commercially available "platinum that contains copper as a main component".

The conductors 311 to 314 are provided along the principal plate surfaces 601 and 602 of the heating object 60, while being adjacent to the magnetic poles 15 and 16. In the present embodiment in particular, the conductors 311 to 314 are arranged so as to be adjacent to the magnetic poles 15 and 16 on both of their left and right sides.

Specifically, on the principal plate surface 601 side, the conductor 311 is arranged on the left of the magnetic pole 15, with the conductor 313 being on the right. Further, on the principal plate surface 602 side, the conductor 312 is arranged on the left of the magnetic pole 16, with the conductor 314 being on the right. Thus, four conductors are symmetrically arranged about the vertical direction and the horizontal direction. In this way, the magnetic pole 15 and the conductors 311 and 313 face the principal plate surface 601, while the magnetic pole 16 and the conductors 312 and 314 face the principal plate surface 602.

It should be noted that, when the heating object 60 is set between the magnetic poles, it is preferable that clearances 49 extending from the conductors 311 to 314 to the principal plate surfaces 601 and 602 (see FIG. 3) are as small as possible.

The lateral magnetic members 41 and 42 are formed of a "magnetic material", such as non-oriented silicon steel, having magnetic permeability sufficiently larger than the air.

The lateral magnetic members 41 and 42 are provided along edge portions 61 and 69, which are end portions of the heating object 60 in the width direction, so as to be apart from the center portion 65 and step over the heating object 60 in the thickness direction. Specifically, the lateral magnetic member 41 is sandwiched between the conductors 311 and 312, while the lateral magnetic member 42 is sandwiched between the conductors 313 and 314. In addition, the lateral magnetic members 41 and 42 are in contact with the adjacent conductors 311 to 314.

Further, the expression "along edge portions 61 and 69" refers to that the lateral magnetic members 41 and 42 are provided "near both outer sides of the edge portions 61 and 69, with substantially no gap being formed relative to the edge portions 61 and 69".

The following is a description of specific concepts of the "edge portions 61 and 69" and the "center portion 65". As shown in FIGS. 2 and 3, a portion sandwiching a center C in the width direction of the heating object 60 is referred to as the "center portion 65", a left end portion is referred to as the "edge portion 61", and a right end portion is referred to as the "edge portion 69".

When the left end is 0% and the right end is 100% in the width direction, the edge portion 61 corresponds to about 0% to 10%, the center portion 65 corresponds to about 40% to about 60%, and the edge portion 69 corresponds to about 90% to 100%, as an example. However, the exemplified numerical values depend such as on the dimension of the width of the heating object 60.

As viewed from the front in FIGS. 1 and 3, i.e. in "a projection on a plane perpendicular to the principal plate surfaces 601 and 602 including the width direction of the heating object (i.e., the objet being heated) 60", the magnetic poles 15 and 16, the conductors 311 to 314, and the lateral magnetic members 41 and 42 are circumferentially adjacent to each other, surrounding or covering the set heating object 60.

Besides, peripheral devices, not shown, used together with the induction heating apparatus 101 are provided, including the power output device that supplies output-controllable power to the coil 20, and a feeding device that moves the heating object 60 in a front-back direction of the induction heating apparatus 101.

When current is passed through the coils 20 and 25 in the induction heating apparatus 101 configured as described above, the magnetic flux Φ generated in the flux generation portions 11 and 12 of the core 10 is transferred to the outer transfer portion 13 and the inner transfer portion 14, and concentrated on the pseudo N pole 15. On the other hand, reversely following the arrows, the magnetic flux Φ is transferred from the flux generation portions 11 and 12 to the outer transfer portion 18 and the inner transfer portion 17, and concentrated on the pseudo S pole 16.

Where the heating object 60 that is an aluminum plate is concerned, magnetic flux Φc that flows from the magnetic pole 15 toward the magnetic pole 16 hardly passes through the center portion 65 and thus takes a detour toward the edge portions 61 and 69. However, the conductors 311 to 314 are provided on both sides of the magnetic pole 15 and the magnetic pole 16. The conductors 311 to 314 are unlikely to permit alternating current magnetic field to pass therethrough and hence, as shown by mark "x" in FIG. 3, shut off the magnetic flux taking a detour. It should be noted that the expression "shut off the magnetic flux" does not necessarily mean 100% shutoff but mean "shutoff of a main flow of the magnetic flux".

Thus, the conductors 311 to 314 allow the magnetic flux Φc to concentrate on the center portion 65.

On the other hand, magnetic flux Φe passes through the clearances 49 between the conductors 311 to 314 and the heating object 60, detouring around the edge portions 61 and 69, and is introduced to the lateral magnetic members 41 and 42 provided near the respective edge portions 61 and 69. Then, the magnetic flux Φe passes through the lateral magnetic members 41 and 42 as magnetic paths and steps over the heating object 60 in the thickness direction. In this way, the magnetic flux Φe passing through the edge portions 61 and 69 is reduced to thereby mitigate the flux density in the edge portions 61 and 69.

Advantageous Effects

The induction heating apparatus 101 configured as described above provides the advantageous effects as follows.

(1) The induction heating apparatus 101 is particularly characterized in that the apparatus includes in particular the conductors 311 to 314 and the lateral magnetic members 41 and 42.

The conductors 311 to 314 are provided along the principal plate surfaces 601 and 602 of the heating object 60, while being adjacent to the magnetic poles 15 and 16. Thus, the conductors 311 to 314 shut off the magnetic flux that flows along the principal plate surface 601 and 602 toward a direction of departing from the magnetic poles 15 and 16. In other words, the conductors 311 to 314 shut out the magnetic flux that flows from the center portion 65 of the heating object 60 and detours around the edge portions 61 and 69. Thus, the magnetic flux Φc passing through the center portion 65 is increased, temperature rise in the center portion 65 is accelerated, and heating efficiency is improved.

The lateral magnetic members 41 and 42 are formed of a magnetic material having sufficiently large relative magnetic permeability larger than 1. The lateral magnetic members 41 and 42 are provided near both outer sides of the respective edge portions 61 and 69, with substantially no gap being formed relative to the respective edge portions 61 and 69.

Thus, magnetic density concentrated on the edge portions 61 and 69 is mitigated, induction current is uniformised, and heat uniformity of the heating object 60 is improved.

(2) The magnetic poles 15 and 16 are arranged, being paired in a direction of sandwiching the principal plate surfaces 601 and 602 of the heating object 60. Also, the lateral magnetic members 41 and 42 introduce the magnetic flux that flows from the principal plate surface 601 of the heating object 60, detouring around the edge portions 61 and 69, toward the principal plate surface 602.

Thus, application of the apparatus to the generally used plate-shaped heating object 60 is facilitated. The term "generally used" herein refers to excluding, for example, a looped heating object 80 of a seventh embodiment which will be described later.

(3) Two or more conductors 311 to 314 are provided on both sides of the magnetic poles 15 and 16, being adjacent thereto, in the width direction of the heating object 60, while two or more lateral magnetic members 41 and 42 are provided relative to the respective edge portions 61 and 69 at both ends of the heating object 60.

Thus, when the heating object 60 is desired to be entirely heated, uniform induction current is generated.

(4) Since the lateral magnetic members 41 and 42 are in contact with the adjacently located conductors 311 to 314, magnetic flux leakage can be reduced in the vicinity of the heating object 60.

(5) The magnetic poles 15 and 16, the conductors 311 to 314, and the lateral magnetic members 41 and 42 are circumferentially adjacent to each other, surrounding or covering the set heating object 60. By surrounding the heating object 60 by reducing gaps as much as possible, magnetic flux leakage can be reduced in the vicinity of the heating object 60.

(Experimental Result)

An experiment was conducted to compare the effects of the induction heating apparatus 101 with those of a comparative example.

Figure 11:
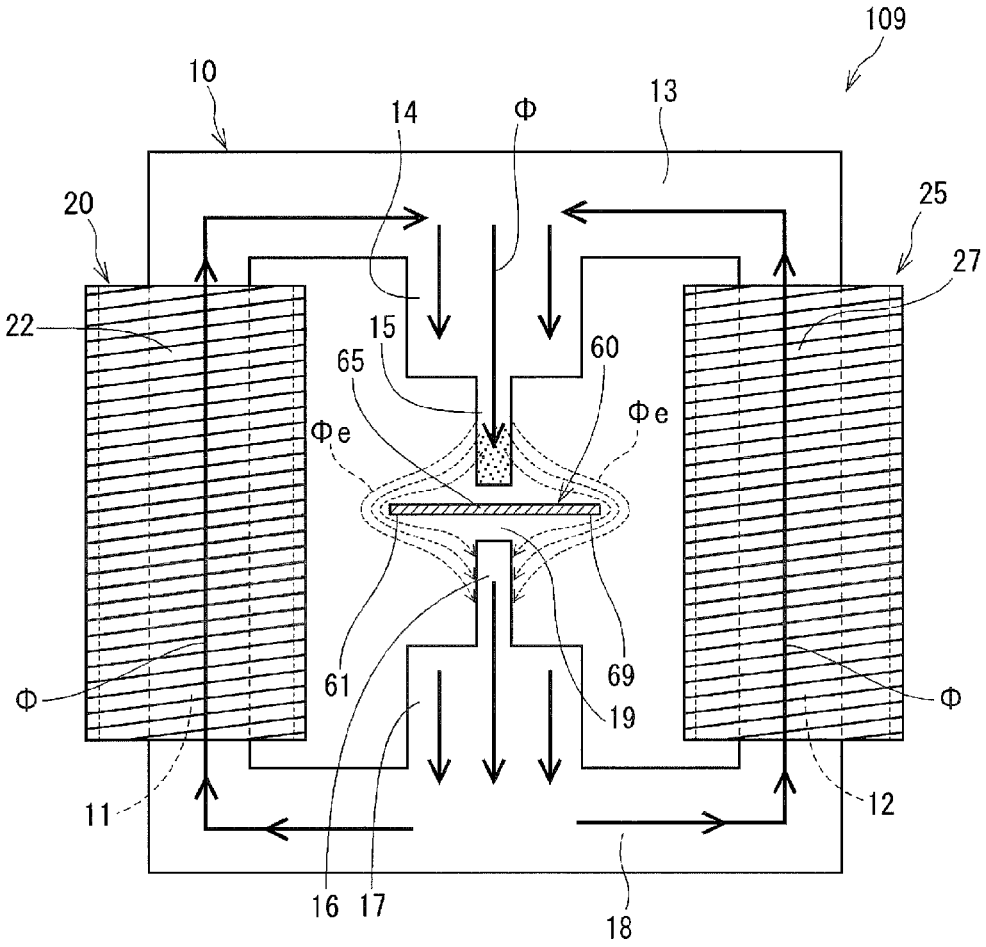
FIG. 11 is a schematic diagram illustrating an induction heating apparatus according to a comparative example.

As shown in FIG. 11, an induction heating apparatus 109 of the comparative example has a core 10 and coils 20 and 25 whose configurations are substantially the same as those of the present embodiment, but has no conductors 311 to 314 or lateral magnetic members 41 and 42.

Figure 4:
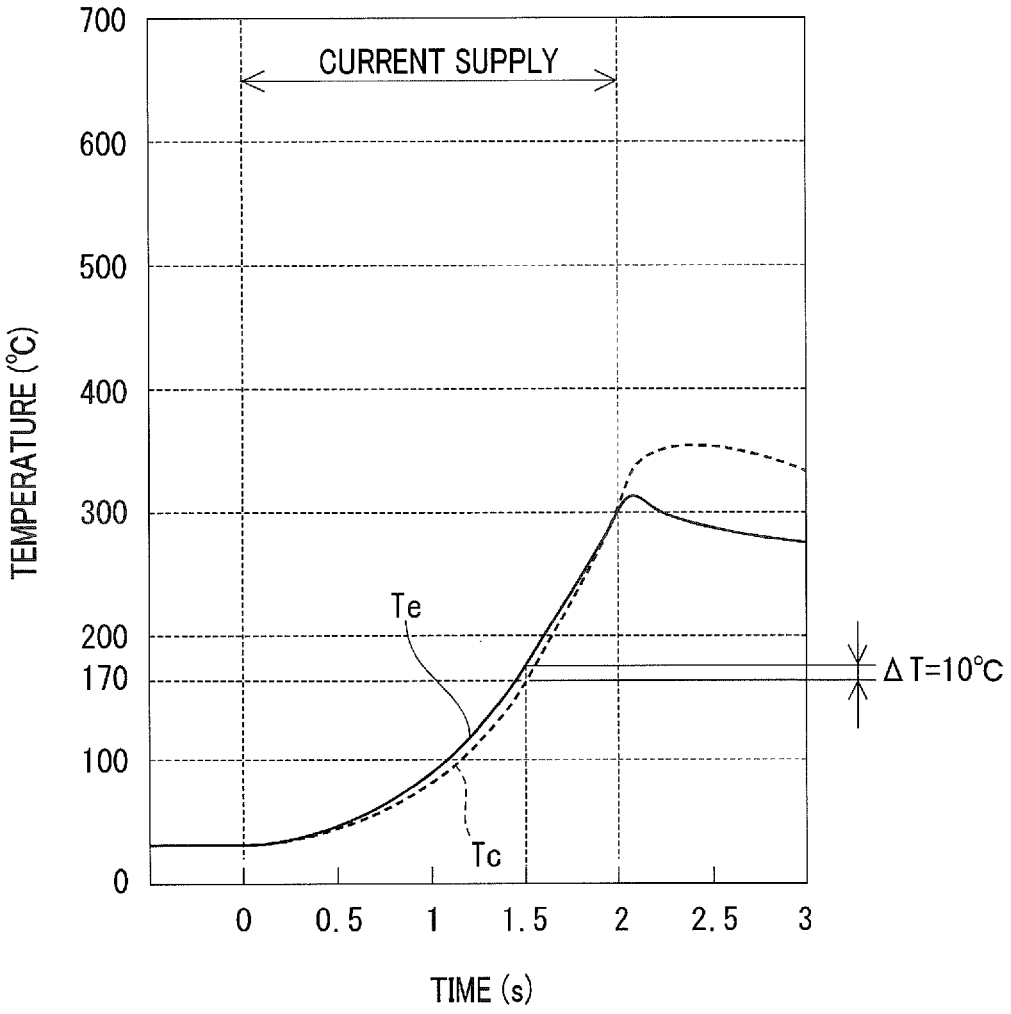
FIG. 4 is a diagram illustrating temperature rise characteristics of a heating object, using the induction heating apparatus according to the first embodiment of the present invention.
Figure 12:
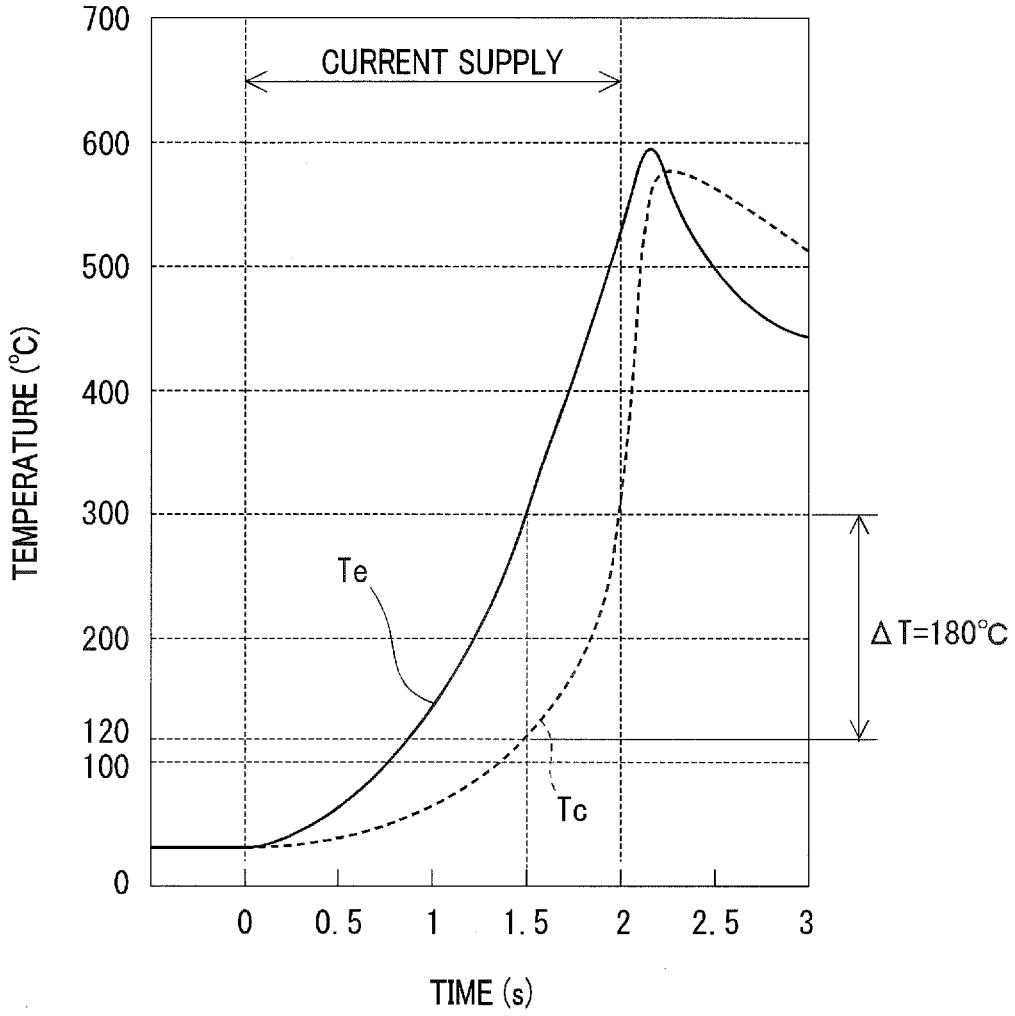
FIG. 12 is a diagram illustrating temperature rise characteristics of a heating object, using the induction heating apparatus of the comparative example.

Using the induction heating apparatus 101 of the present embodiment and the induction heating apparatus 109 of the comparative example, the heating object 60 formed of an aluminum plate was heated under the same conditions. FIGS. 4 and 12 each show temperature rise characteristics resulting from the heating, i.e. temperature rise characteristics of temperature Tc in the center portion 65 and those of temperature Te in the edge portions 61 and 69.

Heating conditions were set so that the power output for passing current to the coils 20 and 25 was equal, and the duration of passing current was two seconds. Then, comparison was made in respect of the temperature Tc of the center portion, and a temperature difference ΔT between the temperature Te of the edge portion and the temperature Tc of the center portion, which were measured after 1.5 seconds from the start of current supply.

As shown in FIG. 4, when heating was conducted using the induction heating apparatus 101 of the present embodiment, the temperature rise characteristics of the temperature Tc of the center portion during current supply coincided well with those of the temperature Te of the edge portion. The temperature Tc of the center portion after 1.5 seconds from the start of current supply was about 170° C., and the temperature difference ΔT was about 10° C.

On the other hand, as shown in FIG. 12, when heating was conducted using the induction heating apparatus 109 of the comparative example, temperature rise was preceded by the temperature Te of the edge portion and the temperature rise was rapid. Then, the temperature Tc of the center portion rose with a delay. This is considered to be because the temperature of the center portion 65 was increased by the heat transferred from the edge portions 61 and 69. The temperature Tc of the center portion after 1.5 seconds from the start of current supply was about 120° C., and the temperature difference ΔT was about 180° C.

This experimental result apparently reveals that, compared to the induction heating apparatus 109 of the comparative example, the induction heating apparatus 101 of the present embodiment accelerates the temperature rise of the temperature Tc of the center portion induced by induction heating, and uniformizes the temperature Te of the edge portion with the temperature Tc of the center portion. In this way, the induction heating apparatus 101 is able to remarkably improve heat uniformity and heat efficiency in heating the heating object 60.

Referring now to FIGS. 5 to 10, second to seventh embodiments of the present invention are described. In the embodiments described below, the configuration except for the center portion of the core 10 is similar to the first embodiment. Each of FIGS. 5 to 10 only illustrates the center portion (principal portion) of the core 10, which corresponds to FIG. 3 of the first embodiment. In FIGS. 5 to 9, the components substantially similar to those of the first embodiment are given the same reference numerals for the sake of omitting explanation. Further, the second to sixth embodiments basically provide the advantageous effects similar to the advantageous effects (1) to (5) of the first embodiment.

Second Embodiment

Figure 5:
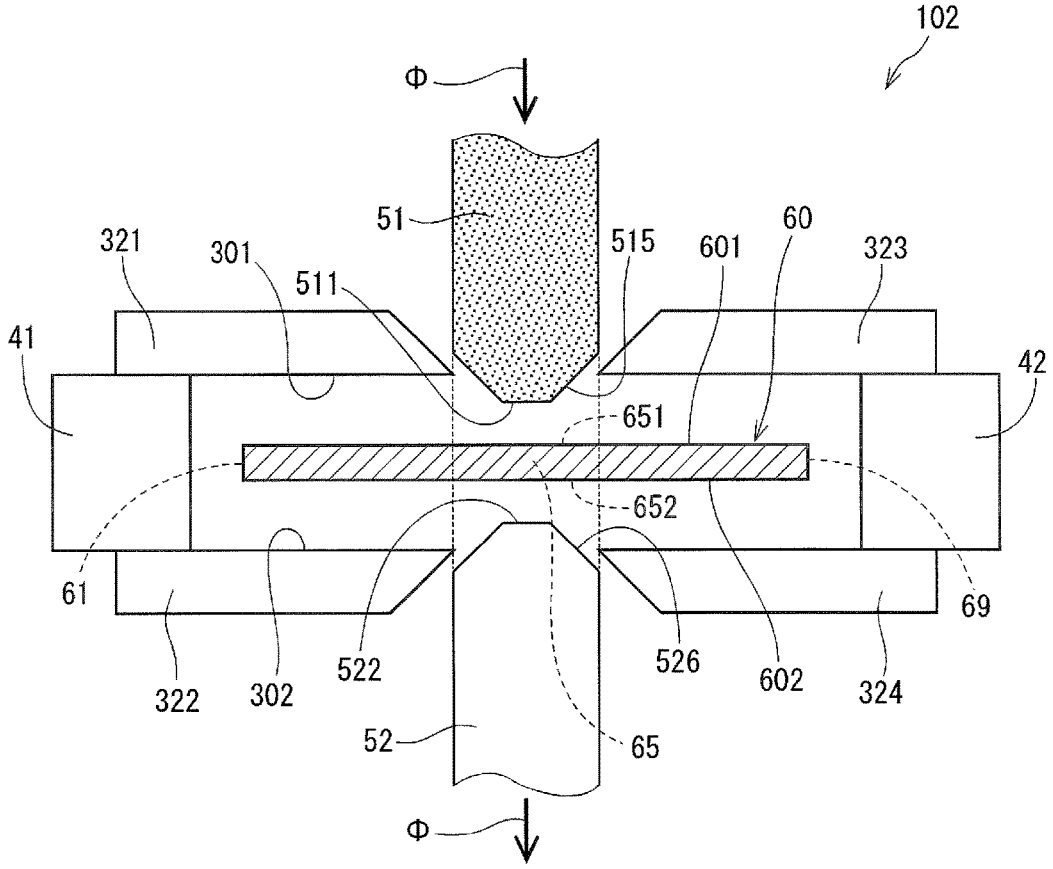
FIG. 5 is a schematic diagram illustrating a principal portion of an induction heating apparatus according to a second embodiment of the present invention.

As shown in FIG. 5, an induction heating apparatus 102 of the second embodiment includes a pseudo N pole 51 and a pseudo S pole 52 having ends whose position and shape are different from those of the magnetic poles 15 and 16 of the first embodiment.

The magnetic pole 51 is provided so that the position of an end 511 is located near the principal plate surface 601 of the heating object 60, relative to an end face 301 of a conductor 321 or 323. The magnetic pole 52 is provided so that the position of an end 522 is located near the principal plate surface 602 of the heating object 60, relative to an end face 302 of a conductor 322 or 324. The magnetic poles 51 and 52 are formed with chamfered portions 515 and 526, respectively, so that the respective ends 511 and 522 are tapered.

Thus, induction current is also generated in portions corresponding to shadows of the magnetic poles 51 and 52 cast on the principle plate surfaces 601 and 602, respectively, i.e. portions 651 and 652 corresponding to projections of the magnetic poles 51 and 52, respectively, on the respective principal plate surfaces 601 and 602, to thereby enable effective heating. Accordingly, heat uniformity is improved.

The conductors 321 to 324 are slanted on a side adjacent to the magnetic poles 51 and 52, at an angle conforming to the chamfered portions 515 and 526. As supplementary feature, the conductors 321 to 324 of the second embodiment each have a small thickness as indicated in the vertical direction of the figure, compared to the conductors 311 to 314 (see FIGS. 1 and 3) of the first embodiment. Thus, the thickness of the conductors does not have a large influence over the function of shutting off the magnetic flux flowing from the magnetic poles.

Third and Fourth Embodiments

Figure 6:
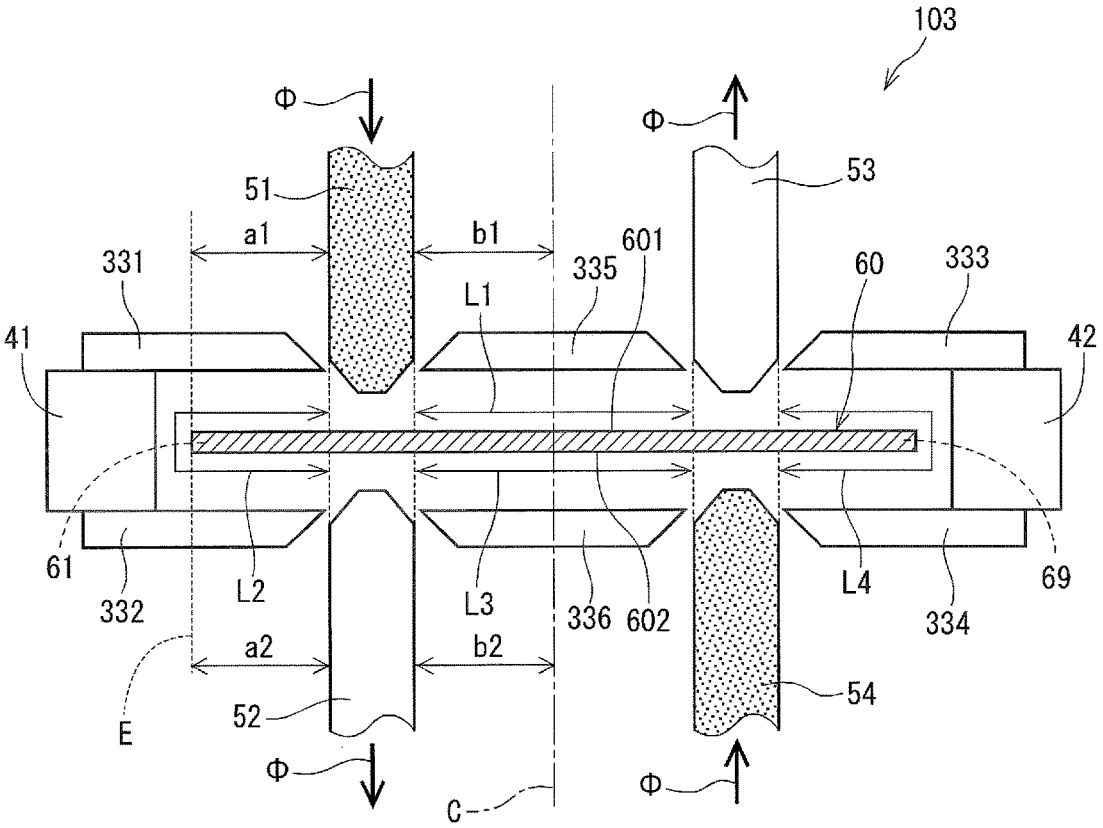
FIG. 6 is a schematic diagram illustrating a principal portion of an induction heating apparatus according to a third embodiment of the present invention.

As shown in FIG. 6, an induction heating apparatus 103 of the third embodiment is provided with a plurality of magnetic poles on each principal plate surface side of the heating object 60. That is, magnetic poles 51 and 53 are provided on a principal plate surface 601 side, while magnetic poles 52 and 54 are provided on a principal plate surface 602 side.

On the principal plate surface 601 side, a conductor 331 is provided on an edge portion 61 side relative to the magnetic pole 51 so as to be adjacent to the magnetic pole 51 and in contact with the lateral magnetic member 41. Similarly, a conductor 333 is provided on an edge portion 69 side relative to the magnetic pole 53 so as to be adjacent to the magnetic pole 53 and in contact with the lateral magnetic member 42. Further, a conductor 335 is provided between the magnetic poles 51 and 53 so as to extend along the principal plate surface 601.

Similarly, conductors 332, 334 and 336 are provided on the principal plate surface 602 side.

It should be noted that the polarity is opposite between the pseudo N pole 51 and the pseudo S pole 53, as well as between the pseudo S pole 52 and the pseudo N pole 54, adjacent to each other on the same principal plate surface side.

The magnetic poles 51 and 52 are in an adjacent relationship in a situation where the principal plate surfaces 601 and 602 folded in the edge portion 61 are virtually expanded. Similarly, the magnetic poles 53 and 54 are in an adjacent relationship in a situation where the principal plate surfaces 601 and 602 folded in the edge portion 69 are virtually expanded. The magnetic poles adjacent to each other relative to the front and back principal plate surfaces also have mutually opposite polarities.

Hereinafter, when simply expressed as "adjacent to", the expression should be construed to include the adjacency on the same principal plate surface side, and the adjacency relative to the front and back of the principal plate surfaces.

In FIG. 6, the reference symbols are defined as follows. It should be noted that, as a precondition, the magnetic poles 51 and 54, as well as the magnetic poles 52 and 53, are arranged so as to have rotational symmetry. Accordingly, description on the left side relative to the center line C is applied to the right side relative to the center line C, the latter being a 180° rotation of the former.

a1: Distance from the magnetic pole 51 to an edge line E (The "edge line E" refers to a line extended from a width-direction end of the heating object 60 so as to be parallel to the center line C.)

b1: Distance from the magnetic pole 51 to the center line C a2: Distance the magnetic pole 52 to the edge line E b2: Distance from the magnetic pole 52 to the center line C L1: Distance between the magnetic poles 51 and 53 on the principal plate surface 601 (=b1+b2)

L2: Distance between the magnetic poles 51 and 52 when the principal plate surfaces 601 and 602 folded in the edge portion 61 are virtually expanded (=a1+a2)

L3: Distance between the magnetic poles 52 and 54 on the principal plate surface 602 (=L1=b1+b2)

L4: Distance between the magnetic poles 53 and 54 when the principal plate surfaces 601 and 602 folded in the edge portion 69 are virtually expanded (=L2=a1+a2)

In the third embodiment, the pair of magnetic poles 51 and 52, and the pair of magnetic poles 53 and 54 are each arranged so that the poles in a pair face each other at respective similar positions in the width direction of the heating object 60. Thus, "a1=a2" and "b1=b2" are satisfied. Further, the magnetic poles 51 to 54 are arranged at positions satisfying "a1≈b1 and a2≈b2". Accordingly, a relation "L1=L3≈L2=L4" is satisfied.

With the configuration as described above, in the induction heating apparatus 103 of the third embodiment, magnetic flux flows from the pseudo N pole 51 to the pseudo S pole 53 along the principal plate surface 601, and also flows from the pseudo N pole 54 to the pseudo S pole 52 along the principal plate surface 602. Thus, induction current is generated near the center portion 65 of the heating object 60. Further, magnetic flux flows from the pseudo N pole 51 to the pseudo S pole 52, turning around the edge portion 61, and also flows from the pseudo N pole 54 to the pseudo S pole 53, turning around the edge portion 69. Thus, induction current is generated near the edge portions 61 and 69. Accordingly, induction current is generated throughout the heating object 60. In this way, the third embodiment can be favorably applied to the heating object 60 having comparatively a large size in the width direction.

Further, since the distances between the adjacent magnetic poles 51 to 54 are equal to each other, magnetic flux can be uniformly generated relative to the heating object 60 having comparatively a large size in the width direction.

Figure 7:
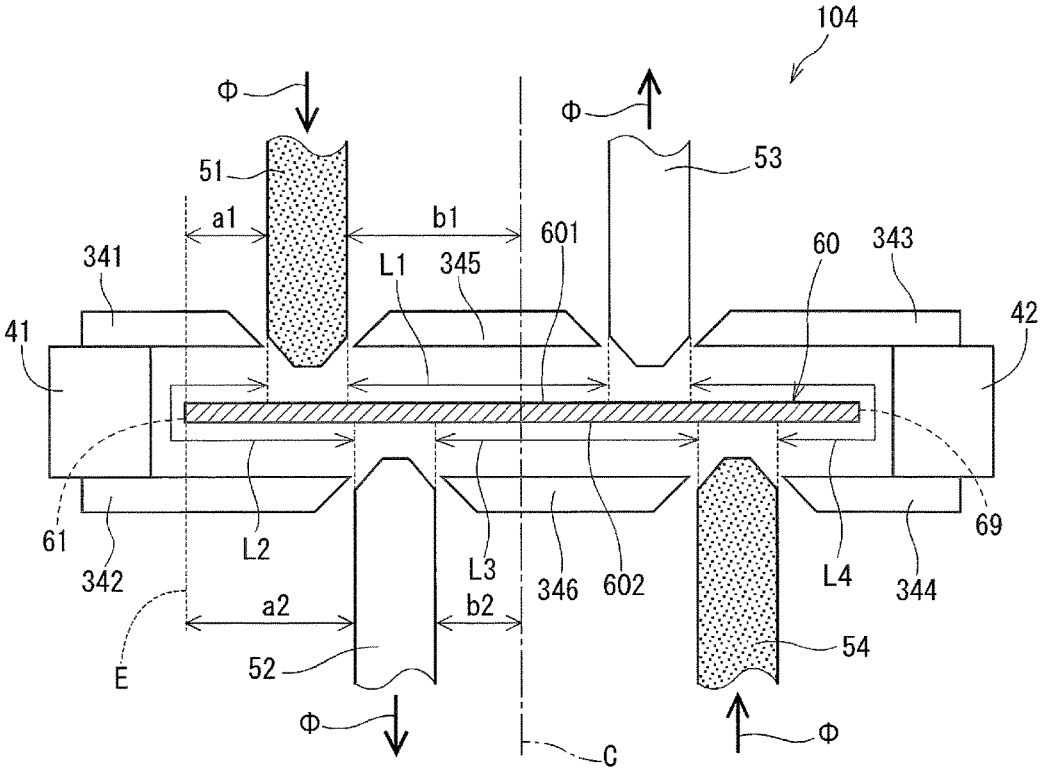
FIG. 7 is a schematic diagram illustrating a principal portion of an induction heating apparatus according to a fourth embodiment of the present invention.

As shown in FIG. 7, an induction heating apparatus 104 according to the fourth embodiment corresponds to a modification of the third embodiment. In the fourth embodiment, the pair of magnetic poles 51 and 52 and the pair of magnetic poles 53 and 54 are each arranged so that the poles in a pair are opposed to each other at positions which are offset from each other in the width direction of the heating object 60. Thus, "a1≠a2" and "b1≠b2" are satisfied. However, the magnetic poles 51 to 54 are arranged at positions satisfying "a1≈b2 and a2≈b1".

Accordingly, in the fourth embodiment as well, a relation "L1=L3≈L2=L4" is established. Thus, the advantageous effects similar to those of the third embodiment can be obtained.

Fifth Embodiment

Figure 8:
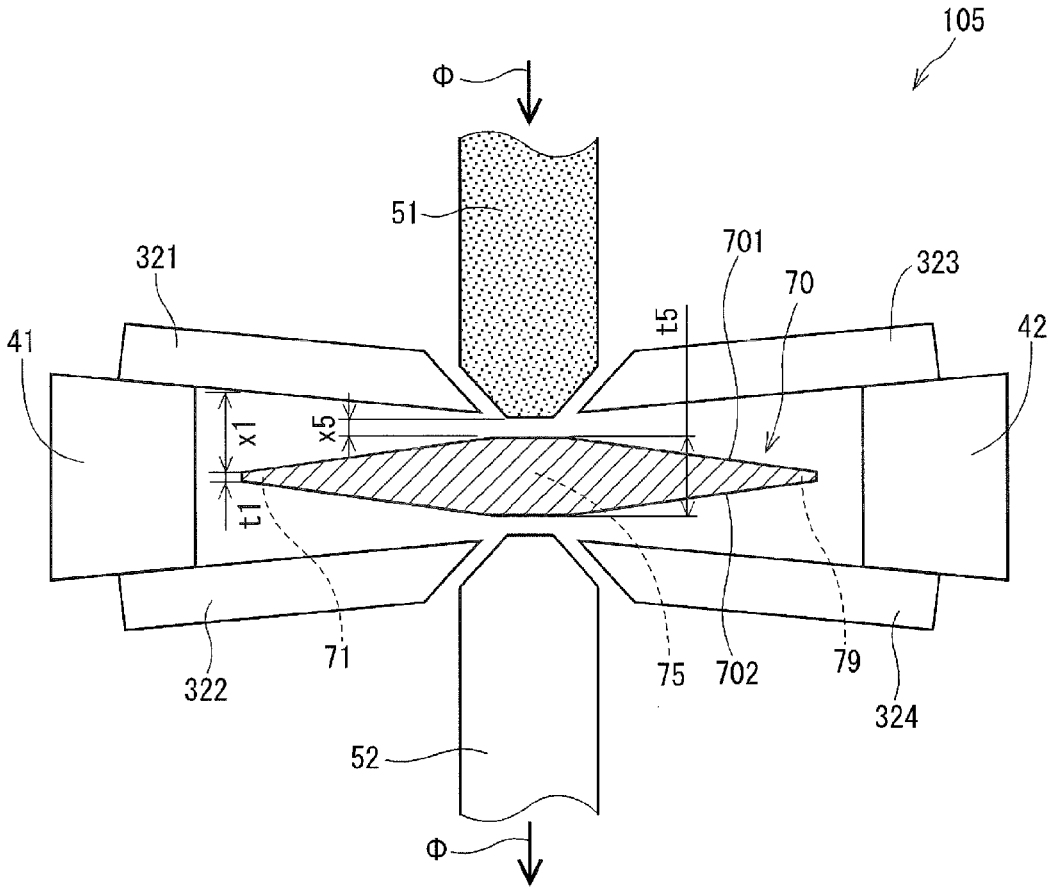
FIG. 8 is a schematic diagram illustrating a principal portion of an induction heating apparatus according to a fifth embodiment of the present invention.

As shown in FIG. 8, an induction heating apparatus 105 according to the fifth embodiment is applied to a heating object 70 having uneven thickness in the width direction. As exemplified in FIG. 8, the heating object 70 has a center portion 75 with a relatively large thickness t5, and edge portions 71 and 79 with a relatively small thickness t1.

The induction heating apparatus 105 has conductors 321 and 323, as well as conductors 322 and 324, which are formed with an inclination so as to be closer to each other toward the inner side in the width direction where the conductors are adjacent to the magnetic poles 51 and 52, and more distanced from each other toward the outer side in the width direction where the conductors are connected to the lateral magnetic members 41 and 42. Similar to the second embodiment, the magnetic poles 51 and 52 have respective ends 511 and 522 which are close to the heating object 70 relative to an end face of each conductor.

Accordingly, in the center portion 75 of the heating object 70, a relatively small clearance x5 is formed on the heating object 70 relative to the magnetic poles 51 and 52, while, in the edge portions 71 and 79, a comparatively large clearance x1 is formed on the heating object 70 relative to the conductors 321 to 324. Specifically, at opposed positions in the width direction, the clearance on the heating object 70 relative to the magnetic poles 51 and 52 or the conductors 321 to 324 is ensured to be in a "negative correlation" with the thickness of the heating object 70. It is particularly favorable that the clearance is ensured to have an inversely proportional relationship with the thickness.

Thus, with respect to the heating object 70 having an uneven thickness, the magnetic flux density in a large thickness portion can be relatively increased to thereby uniformize the induction current passing through the heating object 70 and uniformize generated heat.

In the heating object 70 exemplified in FIG. 8, principal plate surfaces 701 and 702 are each configured by a total of three planes, i.e. the substantially horizontal plane in the center portion 75, and the inclined planes extending from the center portion 75 toward the edge portions 71 and 79 on both sides. Thus, the "principal plate surface of a heating object" is not limited to a single plane. Further, the principal plate surface is not limited to a flat plane but may be a curved plane.

Further, besides the exemplification of FIG. 8, an optimum configuration based on the similar technical idea can be applied to the induction heating apparatus, in the cases where the center portion is thin and the edge portions on both sides are thick, where the thickness gradually increases from one edge portion toward the other edge portion, or where a thick portion and a thin portion are alternately repeated, or the like.

Sixth Embodiment

Figure 9:
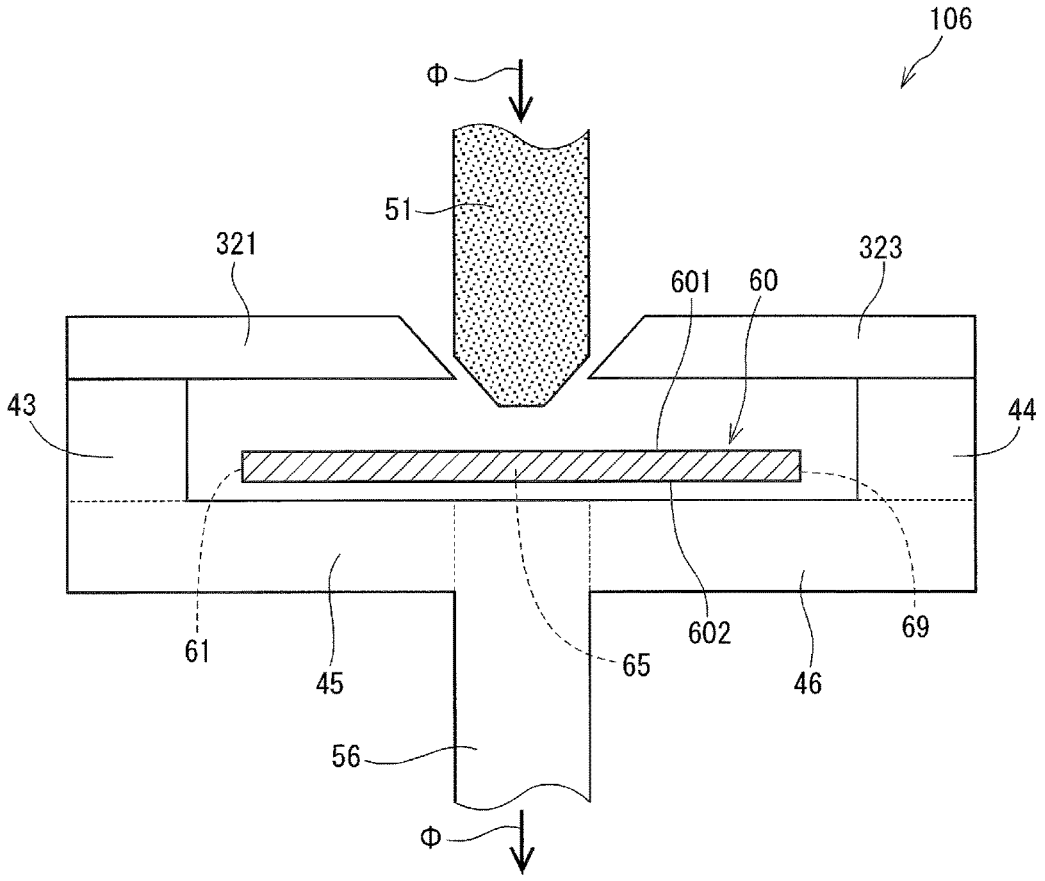
FIG. 9 is a schematic diagram illustrating a principal portion of an induction heating apparatus according to a sixth embodiment of the present invention.

As shown in FIG. 9, an induction heating apparatus 106 according to the sixth embodiment is applied to the case where only one principal plate surface 106 of the heating object 60 is a heating surface. Similar to the foregoing embodiments, the principal plate surface 601 on the front side is faced with the magnetic pole 51, and the conductors 321 and 323 which are adjacent to both sides of the magnetic pole 51.

On the other hand, the principal plate surface 602 is faced with a magnetic pole 56, and connecting magnetic members 45 and 46 which magnetically connect the magnetic pole 56 to lateral magnetic members 43 and 44. The connecting magnetic members 45 and 46 function as magnetic paths that transfer magnetic flux flowing from the conductors 321 and 323 to the lateral magnetic members 43 and 44, respectively, to the magnetic pole 56.

In the example shown in FIG. 9, the magnetic pole 56, the connecting magnetic members 45 and 46, and the lateral magnetic members 43 and 44 are integrally formed.

In the sixth embodiment, induction current is generated on a principal plate surface 601 side of the heating object 60 and only the principal plate surface 601 side can be subjected to induction heating.

Further, since the lateral magnetic members 43 and 44 are integrally formed with the connecting magnetic members 45 and 46, magnetic flux leakage near the heating object 60 can be reduced.

Seventh Embodiment

In any of the first to sixth embodiments described above, one or more pairs of magnetic poles are arranged so that the poles in a pair are opposed to each other in a direction of sandwiching the principal plate surfaces of a heating object. Further, the heating object is basically assumed to be in a substantially rectangular parallelopiped shape.

Figure 10:
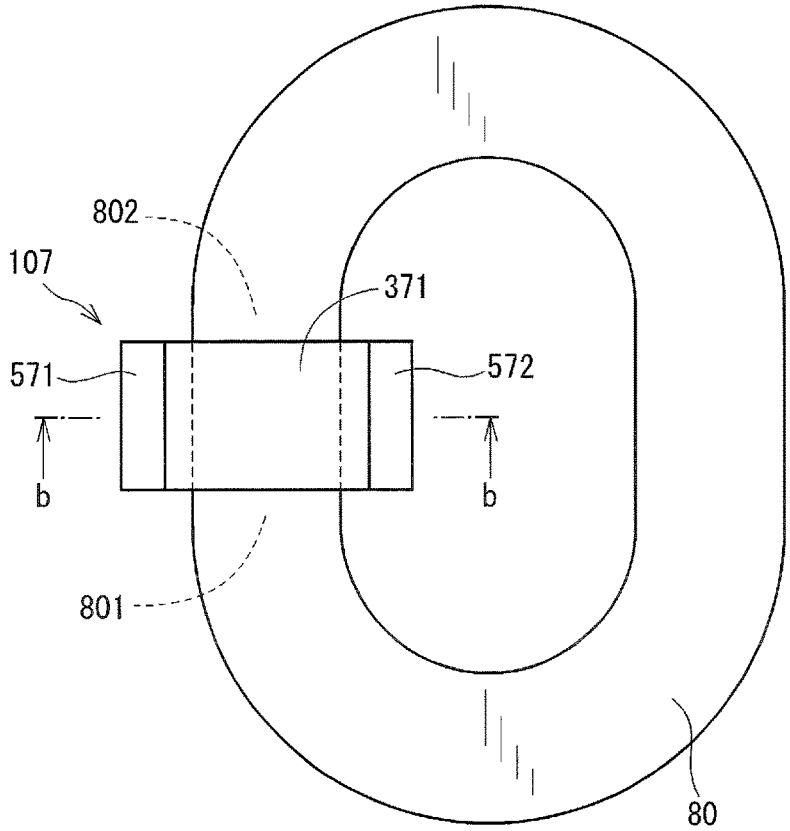
FIG. 10 is a schematic diagram illustrating a principal portion of an induction heating apparatus according to a seventh embodiment of the present invention.
Figure 10:
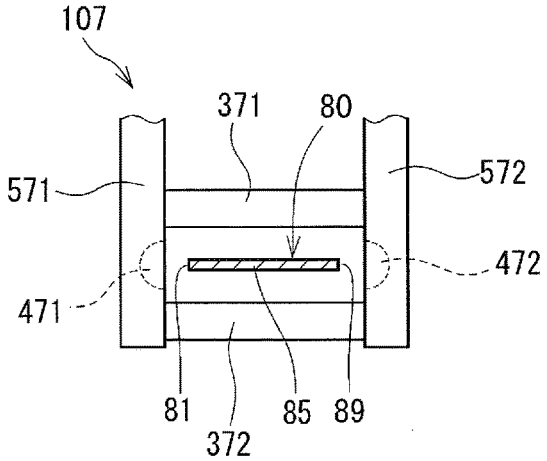

In this regard, as shown in FIG. 10, an induction heating apparatus 107 of the seventh embodiment includes magnetic poles 571 and 572 in a pair, which are parallelly arranged so as to face respective side faces of both edge portions 81 and 89 of a heating object 80. In other words, the magnetic poles 571 and 572 extend in a direction perpendicular to the width direction of the heating object 80. Also, conductors 371 and 372 are arranged along the respective principal plate surfaces of the heating object 80, sandwiching them therebetween, while forming bridges between the magnetic poles 571 and 572.

In a front-and-back direction as viewed in FIG. 10 by (b), this side portion 801 and the other side portion 802 of the heating object 80 are magnetically connected by way of a portion excepting the portion set in the induction heating apparatus 107. For example, the heating object 80 is formed into a looped shape as shown in FIG. 10 by (a).

In the seventh embodiment, as shown in FIG. 10 by (b) with short dashed lines, lateral magnetic members 471 and 472 are considered to be integrally formed with the magnetic poles 571 and 572, respectively. The magnetic poles 571 and 572 in a pair are arranged sandwiching the heating object 80 therebetween. The lateral magnetic members 471 and 472 integrally formed with the respective magnetic poles 571 and 572 in a pair are arranged along the side faces of the respective edge portions 81 and 89 of the heating object 80, in a direction distanced from a center portion 85 relative to the edge portions 81 and 89, and stepping over the heating object 80 in the thickness direction.

In this configuration, the conductors 371 and 372 shut off magnetic flux that flows from the magnetic poles 571 and 572 along the principal plate surfaces of the heating object 80 toward a direction departing from the principal plate surfaces. Accordingly, the magnetic flux is permitted to flow from the magnetic poles 571 and 572 through the looped heating object 80 without vertically escaping from the principal plate surfaces, thereby generating induction current. Thus, the induction heating apparatus 107 is able to heat the heating object 80.

(Other Modifications)

(A) In the first embodiment described above, the core 10 is formed in a shape of a frame, so that magnetic flux generated by the coils 20 and 25 flows from the respective flux generation portions 11 and 12 by way of the magnetic poles 15 and 16, respectively. In this case, the flux generation portion around which a coil is wound may be formed on only one side.

Alternatively, a configuration based on a transverse method may be used, in which the coil that generates magnetic flux flowing on a magnetic pole 15 side is divided from the coil that generates magnetic flux flowing on a magnetic pole 16 side.

(B) In the first embodiment described above, when the up-and-down direction in FIG. 1 is a vertical direction, the heating object 60 is set in a posture that the principal plate surfaces are directed in the horizontal direction. However, the configuration should not be construed as being limited to this. The vertical direction may be the left-and-right direction in FIG. 1, or the vertical direction may be a direction perpendicular to the paper surface of FIG. 1.

(C) As an alternative to copper of the foregoing embodiments, the material of the conductors may be aluminum that is a "non-magnetic metallic material having a relative magnetic permeability of about 1" similar to copper. In this case, the "aluminum" is not limited to pure aluminum but includes a commercially available "alloy that contains aluminum as a main component". Aluminum has excellent heat radiation properties and is particularly advantageous in reducing weight.

Further, the material of the conductors is not limited to a non-magnetic metallic material but may be iron or the like that is a magnetic material. In this case as well, the conductors have properties of "hardly passing alternating current magnetic field" and is able to shut off magnetic flux that takes a detour toward the edge portions from the center portion of a heating object.

(D) Alternative to silicon steel, the material of the lateral magnetic members may be a magnetic material, such as iron.

(E) The material of the heating object is not limited to an aluminum alloy, but may be any material which is electrically conductive.

(F) The shape of the heating object is not limited to a long belt-like shape, as shown in FIG. 2, which is sequentially heated while being fed relative to the induction heating apparatus, but may be of a single body in a plate-like shape which is set one by one.

The "plate-like shape" herein refers to any shape from which at least "a center portion and edge portions in the width direction" can be recognized. For example, in a rectangular parallelopiped shape, the vertical and horizontal scale ratio of a cross section (a ratio of a thickness-direction scale to a width-direction scale) is not limited to the ratios exemplified in the figures of the foregoing embodiments. The "plate-like shape" herein also includes a block shape having a ratio of a thickness-direction scale to a width-direction scale, which is approximate to 1. Further, the "principal plate surface" is not limited to a surface having a largest area in a substantially rectangular parallelopiped shape, but may be a different surface. In short, the principal plate surface is a surface that introduces (receives) alternating magnetic flux.

(G) In the figures showing the first, second, fifth and sixth embodiments, the conductors and the lateral magnetic members are illustrated as being substantially symmetrically arranged on both sides of each magnetic pole. However, the arrangement may be asymmetrical. Further, the conductors and the lateral magnetic members may be provided on only one side of each magnetic pole. For example, when there is a need of uniformizing heating in respect of only one edge portion relative to a center portion in the width direction of a heating object, the conductors and the lateral magnetic members may be ensured to be provided to only the side on which heating is desired to be uniformized.

(H) Alternative to integrally forming three types of members, i.e. the magnetic pole 56, the connecting magnetic members 45 and 46, and the lateral magnetic members 43 and 44, the magnetic pole 56 alone may be separately formed, or the lateral magnetic members 43 and 44 alone may be separately formed, or both of them may be separately formed, followed by joining.

(I) The induction heating apparatus of the present invention may be provided with a temperature sensor that detects a present temperature of the heating object, and the power output may be in feedback-controlled so that the difference between the present temperature and a target temperature is permitted to converge on zero.

(J) As a note for interpretation rather than another embodiment when more appropriately expressed, the terms "pseudo N pole" and "pseudo S pole" in the above description are used on the precondition of centering on a "period where the magnetic flux waveform is positive". Accordingly, as a matter of course, the polarity is inversed in a "period where the magnetic flux waveform is negative". For example, in the sixth embodiment, the pseudo S pole side may be a heating surface.

The present invention should not be construed as being limited to such embodiments, but may be implemented in various modes within a scope not departing from the spirit of the invention.

REFERENCE SIGNS LIST

101 to 107 . . . Induction heating apparatus,
10 . . . Core,
15, 16, 51, 52, 53, 54, 56, 571, 572 . . . Magnetic pole,
20, 25 . . . Coil
311 to 314, 321 to 324, 331 to 336, 341 to 346, 371, 372 . . . Conductor
41, 42, 43, 44, 471, 472 . . . Lateral magnetic member
60, 70, 80 . . . Heating object
61, 69, 71, 79, 81, 89 . . . Edge portion
65, 75, 85 . . . Center portion

What is claimed is:

1. An induction heating apparatus that heats a plate-like heating object having electrical conductivity and a thickness direction, using induction current generated inside the heating object, the apparatus comprising:

a coil that is wound about a core and generates magnetic flux when alternating current is supplied thereto from a power source;

a core that is formed of a magnetic material capable of propagating the magnetic flux, and has one or more pairs of magnetic poles, with the magnetic poles in a pair having mutually opposite magnetic polarities, the one or more pairs of magnetic poles being arranged, on a pair basis, such that the magnetic poles in a pair sandwich therebetween both thickness-direction surfaces of the heating object, and the magnetic poles in a pair are located in a width-direction center portion of the respective both surfaces;

a first magnetic flux control element that shuts off or suppresses propagation of the magnetic flux in at least one of both surfaces of the heating object, the magnetic flux being generated from the magnetic poles, and flowing along the at least one surface toward both width-direction ends of the surface, while departing from the center portion; and a second magnetic flux control element that is arranged near at least one end portion of the both width-direction ends of the heating object, and reduces an amount of the magnetic flux concentrated on the end portion.

2. The induction heating apparatus according to claim 1, wherein:

the first magnetic flux control element is provided on at least one surface side of the both surfaces of the heating object so as to extend along the surface while being adjacent to the magnetic poles, and is configured by a conductor that shuts off magnetic flux flowing along the surface toward a direction of departing from the magnetic poles; and the second magnetic flux control element is formed of a magnetic material, and configured by a lateral magnetic member that is provided relative to at least one of the end portions of the heating object so as to extend along the end portion toward a direction of departing from the width-direction center portion and to step over the heating object in a thickness direction.

3. The induction heating apparatus according to claim 2, wherein:

the one or more pairs of magnetic poles are each arranged in a direction in which the magnetic poles in a pair sandwich therebetween the both surfaces of the heating object; and the lateral magnetic member introduces magnetic flux that flows from the one surface side of the heating object toward an other of the surfaces, detouring around the end portion.

4. The induction heating apparatus according to claim 3, wherein:

the conductor is composed of more than one conductor which is provided so as to be adjacent to the magnetic poles on both sides thereof in a width direction of the heating object; and the lateral magnetic member is composed of more than one lateral magnetic member which is provided relative to the end portions at both ends of the heating object.

5. The induction heating apparatus according to claim 3, wherein the lateral magnetic member is in contact with the conductor located adjacent thereto.

6. The induction heating apparatus according to claim 3, wherein the magnetic poles have ends which are each provided close to the surface of the heating object, relative to the conductor, and are formed so as to be tapered.

7. The induction heating apparatus according to claim 3, wherein:

the magnetic poles are two or more magnetic poles which are provided on a side facing each of the surfaces of the heating object; and the plurality of magnetic poles adjacent to each other on the same one surface side, and the magnetic poles adjacent to each other when the front and back surfaces of the heating object are folded in the end portion and virtually expanded, have mutually opposite polarities.

8. The induction heating apparatus according to claim 3, wherein:

the magnetic poles are two or more magnetic poles which are provided on a side facing each of the surfaces of the heating object; and a distance between the plurality of magnetic poles adjacent to each other on the same one surface side is equal to a distance between the magnetic poles adjacent to each other when the front and back surfaces of the heating object are folded in the end portion and virtually expanded.

9. The induction heating apparatus according to claim 3, wherein, when the heating object having uneven thickness in a width direction is set to the apparatus, a clearance formed on the heating object relative to the magnetic poles, or a clearance formed on the heating object relative to the conductors is set so as to be smaller as the heating object has a larger thickness at corresponding positions.

10. The induction heating apparatus according to claim 3, wherein the magnetic poles and the conductors are opposed to one surface and an other surface of the both surfaces of the heating object.

11. The induction heating apparatus according to claim 3, wherein:

the magnetic pole and the conductors are opposed to the one surface of the both surfaces of the heating object; and the magnetic pole and connecting magnetic members magnetically connecting the magnetic pole to the lateral magnetic members are opposed to the other surface of the both surfaces.

12. The induction heating apparatus according to claim 11, wherein the lateral magnetic members are in contact with the respective connecting magnetic members.

13. The induction heating apparatus according to claim 12, wherein the magnetic pole, the connecting magnetic members and the lateral magnetic members are integrally formed.

14. The induction heating apparatus according to claim 10, wherein, in a projection on a plane perpendicular to the both surfaces including a width direction of the heating object, the magnetic poles, the conductors and the lateral magnetic members, or the magnetic poles, the conductors, the connecting magnetic members and the lateral magnetic members, are adjacent to each other in a circumferential direction, surrounding the heating object set to the apparatus.

15. The induction heating apparatus according to claim 2, wherein the conductor is formed of a non-magnetic metallic material having a relative magnetic permeability equal to that of the air.

16. The induction heating apparatus according to claim 4, wherein the lateral magnetic member is in contact with the conductor located adjacent thereto.

17. The induction heating apparatus according to claim 4, wherein the magnetic poles have ends which are each provided close to the surface of the heating object, relative to the conductor, and are formed so as to be tapered.

18. The induction heating apparatus according to claim 4, wherein:

the magnetic poles are two or more magnetic poles which are provided on a side facing each of the surfaces of the heating object; and the plurality of magnetic poles adjacent to each other on the same one surface side, and the magnetic poles adjacent to each other when the front and back surfaces of the heating object are folded in the end portion and virtually expanded, have mutually opposite polarities.

19. The induction heating apparatus according to claim 4, wherein:

the magnetic poles are two or more magnetic poles which are provided on a side facing each of the surfaces of the heating object; and a distance between the plurality of magnetic poles adjacent to each other on the same one surface side is equal to a distance between the magnetic poles adjacent to each other when the front and back surfaces of the heating object are folded in the end portion and virtually expanded.

20. The induction heating apparatus according to claim 4, wherein, when the heating object having uneven thickness in a width direction is set to the apparatus, a clearance formed on the heating object relative to the magnetic poles, or a clearance formed on the heating object relative to the conductors is set so as to be smaller as the heating object has a larger thickness at corresponding positions.

21. The induction heating apparatus according to claim 1, wherein the first magnetic flux control element is provided on at least one surface side of the both surfaces of the heating object so as to extend along the surface while being adjacent to the magnetic poles.

* * * * *